US008710389B2

(12) United States Patent
Li et al.

(10) Patent No.: US 8,710,389 B2
(45) Date of Patent: Apr. 29, 2014

(54) VACUUM SWITCH AND ELECTRODE ASSEMBLY THEREFOR

(75) Inventors: Wangpei Li, Horseheads, NY (US); Martin Leusenkamp, Hengelo Ov. (NL)

(73) Assignee: Eaton Corporation, Cleveland, OH (US)

( * ) Notice: Subject to any disclaimer, the term of this patent is extended or adjusted under 35 U.S.C. 154(b) by 259 days.

(21) Appl. No.: 13/296,503

(22) Filed: Nov. 15, 2011

(65) Prior Publication Data

US 2013/0119021 A1 May 16, 2013

(51) Int. Cl.
*H01H 33/664* (2006.01)

(52) U.S. Cl.
USPC ..... 218/124

(58) Field of Classification Search
USPC ..... 218/118–126
See application file for complete search history.

(56) References Cited

U.S. PATENT DOCUMENTS

| | | | | |
|---|---|---|---|---|
| 3,469,050 A | | 9/1969 | Alexander et al. | |
| 3,679,474 A | | 7/1972 | Rich | |
| 4,041,261 A | * | 8/1977 | Rich | 218/126 |
| 4,063,126 A | | 12/1977 | Rich et al. | |
| 4,320,269 A | | 3/1982 | Rich et al. | |
| 5,444,201 A | | 8/1995 | Schulman et al. | |
| 5,461,205 A | * | 10/1995 | Schulman | 200/5 R |
| 6,080,952 A | * | 6/2000 | Okutomi et al. | 218/118 |
| 6,163,002 A | * | 12/2000 | Ahn et al. | 218/123 |
| 6,476,338 B2 | * | 11/2002 | Shioiri et al. | 218/118 |
| 7,173,208 B2 | * | 2/2007 | Harada et al. | 218/123 |
| 7,242,570 B2 | * | 7/2007 | Takahashi | 361/290 |
| 7,820,934 B2 | * | 10/2010 | Cardoletti et al. | 218/136 |
| 8,263,894 B2 | * | 9/2012 | Tak et al. | 218/123 |

FOREIGN PATENT DOCUMENTS

| | | |
|---|---|---|
| DE | 1262407 | 3/1968 |
| EP | 0167479 A1 | 6/1986 |
| GB | 2199991 A | 7/1988 |

OTHER PUBLICATIONS

European Patent Office, "International Search Report and Written Opinion", Jan. 30, 2013.

* cited by examiner

*Primary Examiner* — Truc Nguyen
(74) *Attorney, Agent, or Firm* — Eckert Seamans Cherin & Mellott, LLC; Grant E. Coffield

(57) ABSTRACT

An electrode assembly is provided for a vacuum switch, including a vacuum envelope, a fixed contact assembly including a fixed contact disposed within the vacuum envelope, and a movable contact assembly including a movable contact disposed within the vacuum envelope and movable between a closed position in electrical contact with the fixed contact and an open position spaced apart from the fixed contact. The electrode assembly includes at least one electrode bundle having a plurality of electrodes coupled to a corresponding one of the fixed contact assembly and the movable contact assembly. The electrodes extend from at or about a corresponding one of the fixed contact and the movable contact toward the closer of the first end of the vacuum envelope and the second end of the vacuum envelope.

20 Claims, 4 Drawing Sheets

VACUUM SWITCH AND ELECTRODE ASSEMBLY THEREFOR

BACKGROUND

1. Field

The disclosed concept relates to vacuum switching apparatus such as, for example, vacuum switches including a vacuum envelope such as, for example, vacuum interrupters. The disclosed concept also pertains to electrode assemblies for vacuum interrupters.

2. Background Information

Vacuum interrupters include separable main contacts disposed within an insulated and hermetically sealed vacuum chamber. The vacuum chamber typically includes, for example and without limitation, a number of sections of ceramics (e.g., without limitation, a number of tubular ceramic portions) for electrical insulation capped by a number of end members (e.g., without limitation, metal components, such as metal end plates; end caps; seal cups) to form an envelope in which a partial vacuum may be drawn. The example ceramic section is typically cylindrical; however, other suitable cross-sectional shapes may be used. Two end members are typically employed. Where there are multiple ceramic sections, an internal center shield is disposed between the example ceramic sections.

Vacuum electrical switching apparatus, such as vacuum circuit interrupters (e.g., without limitation, vacuum circuit breakers; vacuum switches; load break switches), provide protection for electrical systems from electrical fault conditions such as, for example, current overloads, short circuits, and low level voltage conditions. Typically, vacuum circuit interrupters include a spring-powered or other suitable operating mechanism, which opens electrical contacts inside a number of vacuum interrupters to interrupt the current flowing through the conductors in an electrical system in response to abnormal conditions.

The main contacts of vacuum interrupters are electrically connected to an external circuit to be protected by the vacuum circuit interrupter by electrode stems, typically an elongated member made from high purity copper. Generally, one of the contacts is fixed relative to the vacuum chamber as well as to the external circuit. The fixed contact is mounted in the vacuum envelope on a first electrode extending through one end member. The other contact is movable relative to the vacuum envelope. The movable contact is mounted on a movable electrode axially slidable through the other end member. The movable contact is driven by the operating mechanism and the motion of the operating mechanism is transferred inside the vacuum envelope by a coupling that includes a sealed metallic bellows. The fixed and movable contacts form a pair of separable contacts which are opened and closed by movement of the movable electrode in response to the operating mechanism located outside of the vacuum envelope. The electrodes, end members, bellows, ceramic shell(s), and the internal shield, if any, are joined together to form the vacuum interrupter (VI) capable of maintaining a partial vacuum at a suitable level for an extended period of time.

The vacuum interrupter is only actively called upon, in abnormal conditions, to interrupt the fault current by opening the movable contact from the fixed contact. The majority of the time the vacuum interrupter is in the closed position with the movable contact in electrical connection with the fixed contact, passively passing the rated (i.e., normal) circuit current continuously. Due to the inherent electrical resistance of the vacuum interrupter itself, the passing of the continuous current generates heat, leading to a rise in the temperature of the components of the vacuum interrupter as well as the bus bars connected to the vacuum interrupter.

With the wide acceptance of vacuum interruption technology in medium voltage switchgear, vacuum interrupters are being used in more and more demanding applications. One example is the ever increasing continuous current requirement. As a result, the diameter of the electrode stems are becoming bigger and bigger. However, for an electrode with a diameter larger than about 2 inches, for example, the alternative current (AC) resistance, for the practical 50 Hz or 60 Hz currents, is significantly larger than its direct current (DC) resistance, due to skin effect and proximity effect. The size of the vacuum interrupter limits the diameter of the electrodes that can be fitted into it. For this reason, it is difficult to achieve a relatively high continuous current carrying capability of a given vacuum interrupter size.

There is, therefore, room for improvement in vacuum switches, such as vacuum interrupters, and in electrode assemblies therefor.

SUMMARY

These needs and others are met by embodiments of the disclosed concept, which are directed to an improved electrode assembly for vacuum switches.

As one aspect of the disclosed concept, an electrode assembly is provided for a vacuum switch. The vacuum switch comprises a vacuum envelope, a fixed contact assembly including a fixed contact disposed within the vacuum envelope, and a movable contact assembly including a movable contact disposed within the vacuum envelope and movable between a closed position in electrical contact with the fixed contact and an open position spaced apart from the fixed contact. The vacuum envelope includes a first end and a second end disposed opposite and distal from the first end. The electrode assembly comprises: at least one electrode bundle including a plurality of electrodes structured to be coupled to a corresponding one of the fixed contact assembly and the movable contact assembly. The electrodes are structured to extend from at or about a corresponding one of the fixed contact and the movable contact toward the closer of the first end of the vacuum envelope and the second end of the vacuum envelope.

The electrodes may be structured to be completely disposed within the vacuum envelope, or alternatively to extend from within the vacuum envelope through a corresponding one of the first end of the vacuum envelope and the second end of the vacuum envelope.

A first electrode bundle may have a plurality of first electrodes and a second electrode bundle may have a plurality of second electrodes, wherein the first electrode bundle is structured to be disposed on the fixed contact assembly and the second electrode bundle is structured to be disposed on the movable contact assembly.

As another aspect of the disclosed concept, a vacuum switch comprises: a vacuum envelope including a first end and a second end disposed opposite and distal from the first end; a fixed contact assembly including a fixed contact disposed within the vacuum envelope; a movable contact assembly including a movable contact disposed within the vacuum envelope and movable between a closed position in electrical contact with the fixed contact and an open position spaced apart from the fixed contact; and an electrode assembly comprising: at least one electrode bundle including a plurality of electrodes coupled to a corresponding one of the fixed contact assembly and the movable contact assembly. The electrodes extend from at or about a corresponding one of the fixed contact and the movable contact toward the closer of the first end of the vacuum envelope and the second end of the vacuum envelope.

BRIEF DESCRIPTION OF THE DRAWINGS

A full understanding of the disclosed concept can be gained from the following description of the preferred embodiments when read in conjunction with the accompanying drawings in which.

DESCRIPTION OF THE PREFERRED EMBODIMENTS

Figure 1:
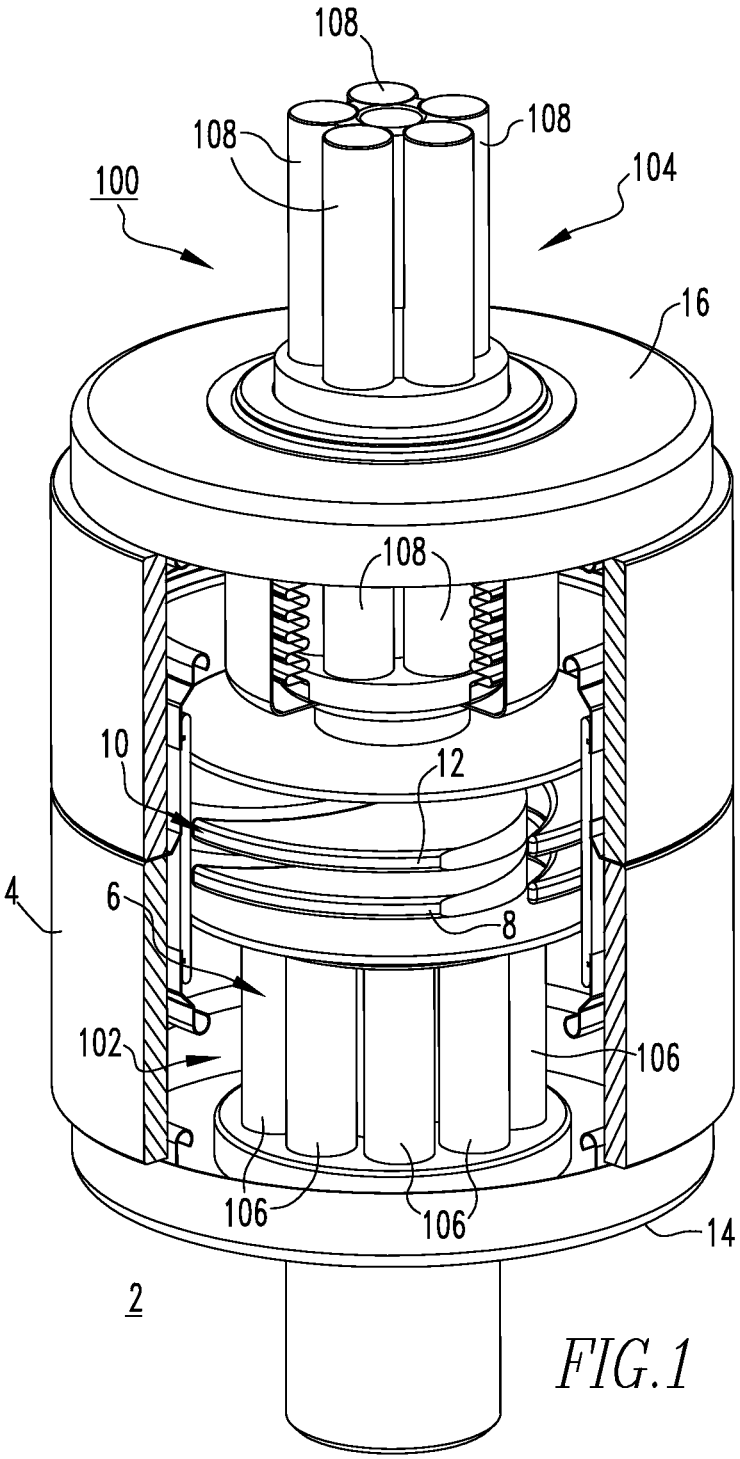
FIG. 1 is an isometric partially in section view of a vacuum interrupter and electrode assembly therefor, in accordance with an embodiment of the disclosed concept.

Directional phrases used herein, such as, for example, left, right, up, down, top, bottom and derivatives thereof, relate to the orientation of the elements shown in the drawings and are not limiting upon the claims unless expressly recited therein.

As employed herein, the term "vacuum envelope" means an envelope employing a partial vacuum therein.

As employed herein, the term "partial vacuum" means a space (e.g., within a vacuum envelope) partially exhausted (e.g., to the highest degree practicable; to a relatively high degree; to a degree suitable for use in a vacuum switching apparatus application) by a suitable mechanism (e.g., without limitation, a vacuum furnace).

As employed herein, the terms "vacuum switching apparatus" or simply "vacuum switch" shall mean a vacuum envelope employing a fixed contact, a movable contact and corresponding fixed electrode and movable electrode that carry the current to and from the contacts. Non-limiting applications for vacuum switching apparatus include a circuit breaker, an interrupter, a switch, a generator circuit breaker, a load breaker switch (LBS), a contactor, a low voltage (LV) switching apparatus, a medium voltage (MV) switching apparatus, a high voltage (HV) switching apparatus, and a vacuum electrical switching apparatus.

As employed herein, the statement that two or more parts are "coupled" together shall mean that the parts are joined together either directly or joined through one or more intermediate parts.

As employed herein, the term "number" shall mean one or an integer greater than one (i.e., a plurality).

FIG. 1 shows a vacuum switch, such as a vacuum interrupter 2, employing an electrode assembly 100, in accordance with one non-limiting embodiment of the disclosed concept. The vacuum switch 2 includes a vacuum envelope 4, which is partially cutaway in FIG. 1 to show hidden structures. A fixed contact assembly 6 is partially within the vacuum envelope 4, and includes a fixed contact 8. A movable contact assembly 10 is also partially within the vacuum envelope 4, and includes a movable contact 12, which is movable (e.g., up and down from the perspective of FIG. 1) between a closed position in electrical contact with the fixed contact 8, and an opened position spaced apart from the fixed contact 8. The vacuum envelope 4 includes first and second opposing ends 14,16.

Figure 2:
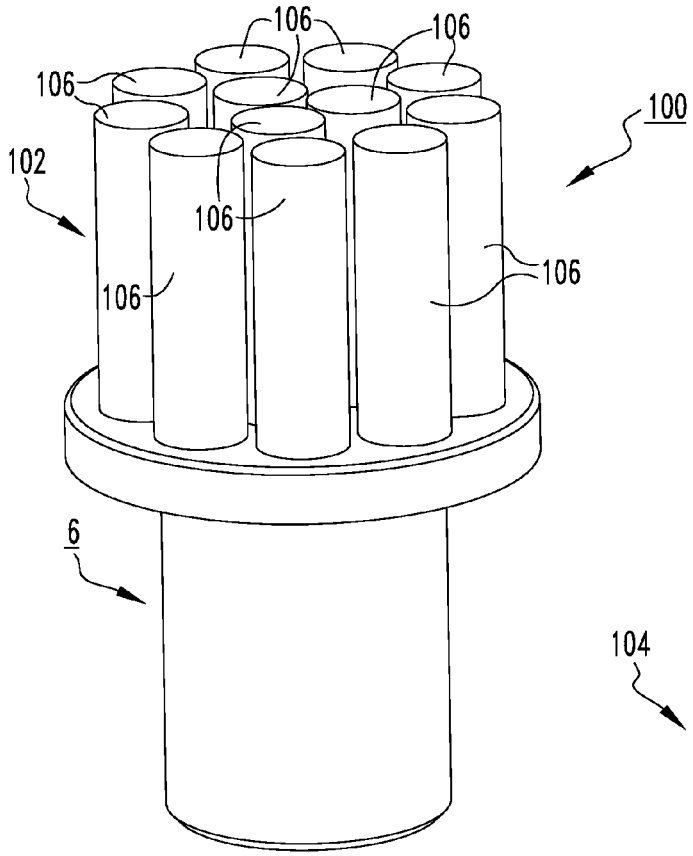
FIG. 2 is an isometric view of a portion of the electrode assembly of FIG. 1.
Figure 3:
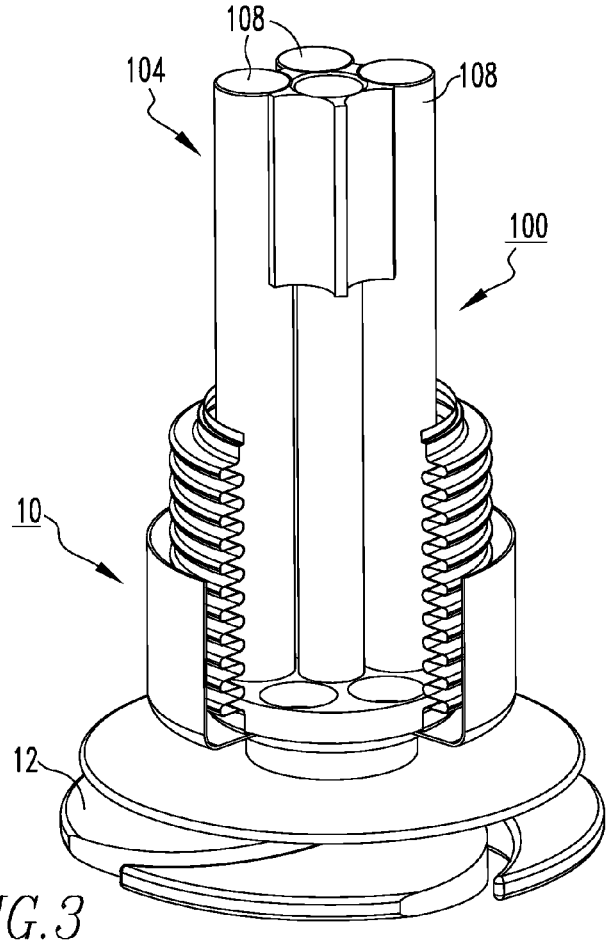
FIG. 3 is an isometric view of another portion of the electrode assembly of FIG. 1.

In the non-limiting example of FIGS. 1-3, the electrode assembly 100 includes at least one electrode bundle 102,104 (two are shown) includes a plurality of electrodes 106,108 structured to be coupled to a corresponding one of the fixed contact assembly 6 and the movable contact assembly 10. More specifically, the electrodes 106,108 extend from at or about a corresponding one of the fixed contact 8 and movable contact 12 toward the closer of the first end 14 of the vacuum envelope 4 and the second end 16 of the vacuum envelope 4. In other words, unlike known prior art vacuum interrupter designs (not shown) having a plurality of electrodes, wherein the electrodes coupled to the fixed end extend toward the movable end of the vacuum envelope and vice versa such that electrodes of the movable contact assembly move between the electrodes of the fixed contact assembly, with the intention to lengthen the arc and rotate the arc among these multiple electrodes, for better arc interruption, the electrode bundles 102,104 of the disclosed concept are generally self-contained on one side of the corresponding fixed contact 8 or movable contact 12, respectively, with the intention to reduce the AC resistance of the electrode assembly. It will also be appreciated that only one of the fixed contact assembly 6 and movable contact assembly 10 and/or only a portion or portions thereof is/are required to have an electrode bundle (e.g., without limitation, 102,104), in accordance with the disclosed concept. That is, while both the fixed contact assembly 6 and movable contact assembly 10 of the example shown and described with reference to FIGS. 1-3 employ electrode bundles 102,104, this is not required to be the case.

It will further be appreciated that the electrodes, for example electrodes 106, may be completely disposed within the vacuum envelope 4. Alternatively, the electrodes, for example electrodes 108, may extend from within the vacuum envelope 4 through a corresponding one of the first and second ends 14,16 of the vacuum envelope 4. For example and without limitation, in the non-limiting example of FIG. 1, electrodes 108 extend from at or about the movable contact 12, within the vacuum envelope 4, through the second end 16 of the vacuum envelope 4 to the exterior thereof.

Continuing to refer to FIG. 1, and also to FIGS. 2 and 3, the electrode assembly 100, shown, includes a first electrode bundle 102 having a plurality of first electrodes 106, and a second electrode bundle 104 having a plurality of second electrodes 108. The first electrode bundle 102 is disposed on the fixed contact assembly 6, and the second electrode bundle 104 is disposed on the movable contact assembly 10. More specifically, the first electrodes 106 generally extend between the fixed contact 8 and the first end 14 of the vacuum envelope 4, and the second electrodes 108 extend from proximate the movable contact 12 through the second end 16 of the vacuum envelope 4, as previously discussed.

As best shown in FIGS. 2 and 3, the first electrode bundle 102 of the example electrode assembly 100 includes twelve first electrodes 106 arranged in a concentric circular pattern, and the second electrode bundle 104 includes five electrodes 108 (all shown in FIG. 1), also arranged in a generally concentric circular pattern. Accordingly, it will be appreciated that a key feature of the disclosed concept is that, instead of a single piece of electrode, a section or sections of the electrode is replaced with a grouping of sub-electrodes of small diameters, defined herein as "electrode bundles," with the intention of reducing the eddy current effect and hence the alternating current (AC) resistance of the entire electrodes assembly 100. It will be appreciated, however, that as previously discussed, only one electrode bundle (e.g., without limitation 102,104) is required, and that any known or suitable alternative size, number and/or configuration of electrodes (e.g., without limitation, 106,108) can be employed, without departing from the scope of the disclosed concept.

Figure 4:
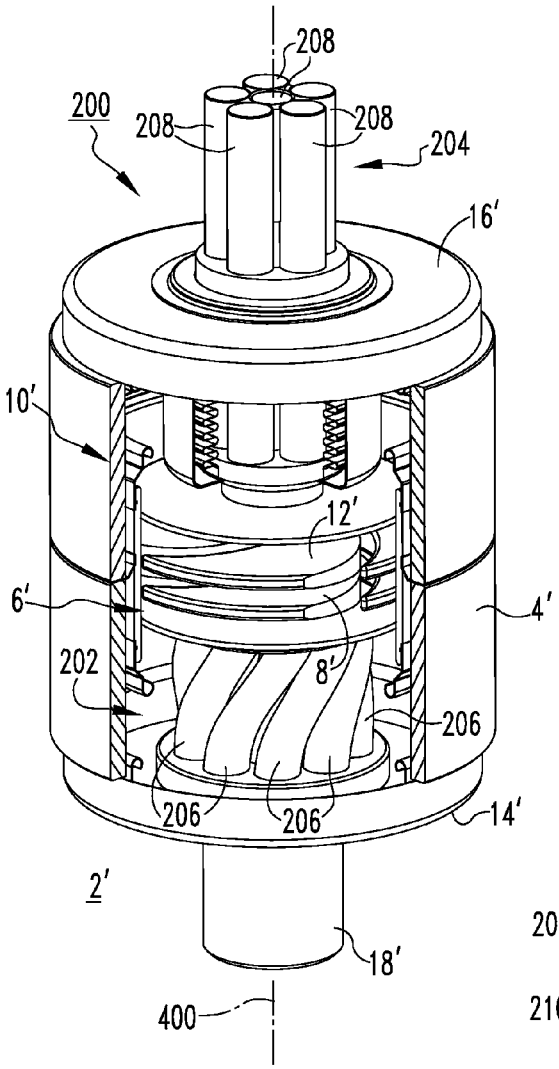
FIG. 4 is an isometric partially in section view of a vacuum interrupter and electrode assembly therefor, in accordance with another embodiment of the disclosed concept.
Figure 5:
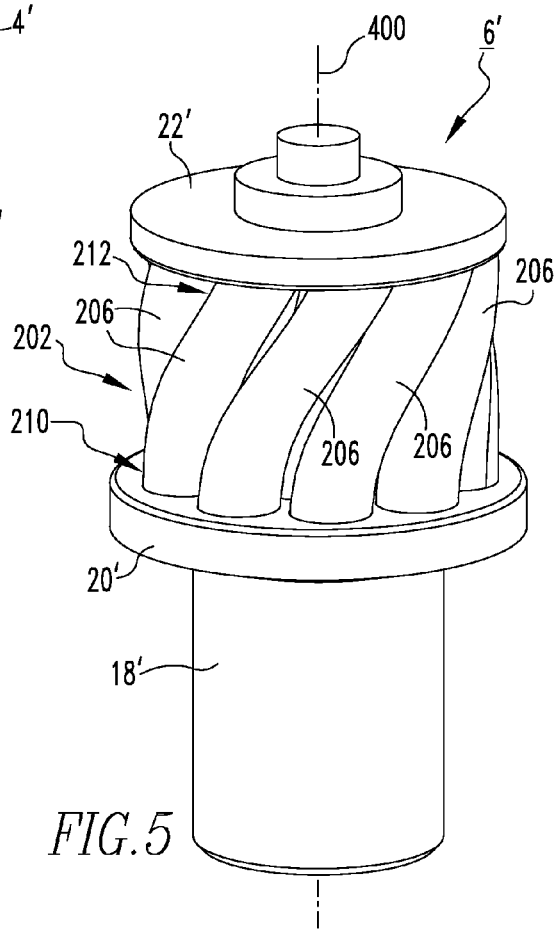
FIG. 5 is an isometric view of a portion of the electrode assembly of FIG. 4.

For example and without limitation, FIGS. 4 and 5 show a non-limiting alternative example embodiment of an electrode assembly 200, in accordance with the disclosed concept, wherein the vacuum switch 2' (FIG. 4) has a longitudinal axis 400, and the electrodes 206 are twisted with respect to such axis 400. More specifically, like the aforementioned vacuum switch 2 discussed hereinabove with respect to FIGS. 1-3, vacuum switch 2' includes a vacuum envelope 4', a fixed contact assembly 6' including a fixed contact 8' disposed within the vacuum envelope 4', and a movable contact assembly 10' including a movable contact 12' disposed within the vacuum envelope 4' and movable between a closed position in electrical contact with the fixed contact 8' and an open position spaced apart from the fixed contact 8'. The vacuum envelope 4' further includes first and second opposing ends 14',16'.

In the example of FIGS. 4 and 5, the fixed contact assembly 6' further includes a stem 18', a first planar member 20', and a second planar member 22', which is disposed opposite and distal from the first planar member 20'. As previously discussed, the electrodes 206 are twisted with respect to the longitudinal axis 400. That is, each of the electrodes 206 includes a first end 210, which is coupled to the first planar member 20', and a second end 212, which is coupled to the second planar member 22'. The second end 212 of each electrode 206 is offset with respect to the first end 210 of such electrode 206, as best shown in FIG. 5. In other words, the electrodes 206 are twisted so as to further reduce the eddy current effect and hence the AC resistance.

Figure 6:
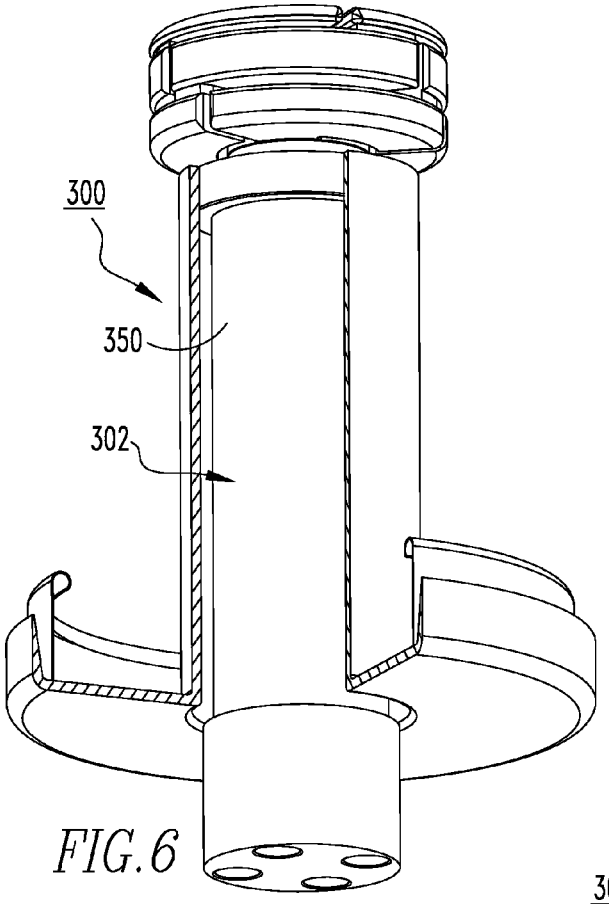
FIG. 6 is an isometric partially in section view of a portion of a vacuum interrupter and electrode assembly therefor, in accordance with another embodiment of the disclosed concept.
Figure 7:
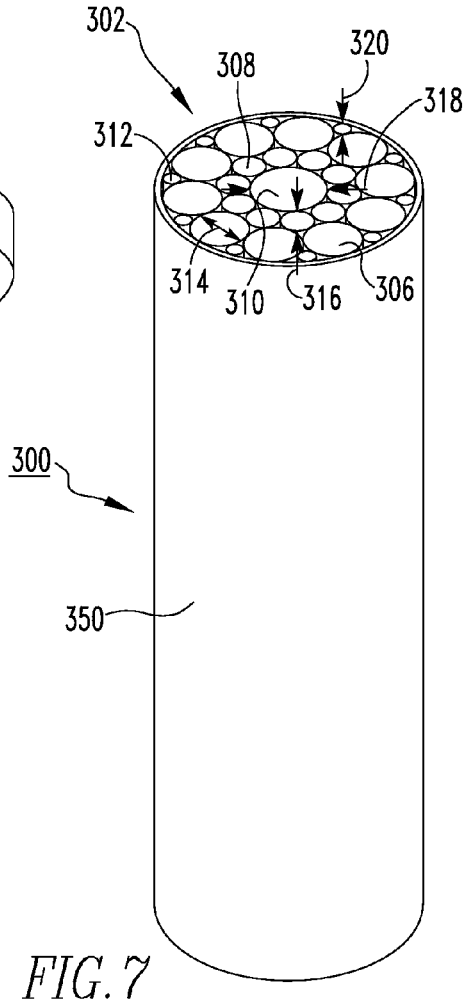
FIG. 7 is an isometric view of a portion of the electrode assembly of FIG. 6.

FIGS. 6 and 7 show a further non-limiting alternative embodiment of an electrode assembly 300, wherein the electrode bundle 302 further includes a sleeve 350 and the electrodes 306,308,310,312 (FIG. 7) are disposed within the sleeve 350. The electrodes 306,308,310,312 may be woven or braided in a certain pattern, for example and without limitation, such as the Litz Wire pattern, to reduce the skin effect and the proximity effect of an AC current in the electrode, and hence the electrical resistance. It will be appreciated that this is true whether or not the electrodes are disposed within a sleeve (e.g., 350), which is not required. FIG. 7 also illustrates another non-limiting aspect of the disclosed concept. That is, the electrodes of any known or suitable electrode bundle (e.g., without limitation, 302), in accordance with the disclosed concept, may have different diameters. In FIG. 7, four different electrode diameters are employed in the weaving or braiding manner within the sleeve 350. Specifically, ten first electrodes 306 are arranged in a generally circular pattern around the outer circumference just inside the sleeve 350. Ten second electrodes 308 are then disposed inward of first electrodes 306 in between first electrodes 306 and a central electrode 310. Finally, interspersed between the outer most row of electrodes 306, are fourth electrodes 312, as shown. It will be appreciated that all of the electrodes 306,308,310,312 can have any known or suitable diameter. For example and without limitation, the example first electrodes 306 have a first diameter 314, second electrodes 308 have a second diameter 316, third electrodes 310 have a third diameter 318, and fourth electrodes 312 have a fourth diameter 320, all of which are different.

Yet another non-limiting aspect of the disclosed concept is to make one or more of the electrodes of the electrode bundle, for example and without limitation, the center electrode 310 in FIG. 7, out of a less electrically conductive, but mechanically stronger, material (e.g., without limitation, stainless steel) to improve the mechanical strength, and yet without sacrificing the electrical conductivity of the electrode assembly (e.g., 300).

Accordingly, the disclosed concept provides an electrode assembly (e.g., without limitation, 100,200,300), which among other benefits, is structured to increase the continuous current carrying capability of a vacuum interrupter (e.g., without limitation, 2 and 2') by replacing the conventional single relatively large diameter electrode with a plurality of relatively smaller diameter electrodes bundled together to carry relatively high continuous currents.

While specific embodiments of the disclosed concept have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the disclosed concept which is to be given the full breadth of the claims appended and any and all equivalents thereof.

What is claimed is:

1. An electrode assembly for a vacuum switch, said vacuum switch comprising a vacuum envelope, a fixed contact assembly including a fixed contact disposed within said vacuum envelope, and a movable contact assembly including a movable contact disposed within said vacuum envelope and movable between a closed position in electrical contact with the fixed contact and an open position spaced apart from the fixed contact, said vacuum envelope including a first end and a second end disposed opposite and distal from the first end, said electrode assembly comprising:

at least one electrode bundle comprising a grouping of a plurality of separate relatively small diameter electrodes structured to be bundled together and coupled to a corresponding one of said fixed contact assembly and said movable contact assembly, wherein said electrodes are structured to extend from at or about a corresponding one of the fixed contact and the movable contact toward the closer of the first end of said vacuum envelope and the second end of said vacuum envelope.

2. The electrode assembly of claim 1 wherein said electrodes are structured to be completely disposed within said vacuum envelope.

3. The electrode assembly of claim 1 wherein said electrodes are structured to extend from within said vacuum envelope through a corresponding one of the first end of said vacuum envelope and the second end of said vacuum envelope.

4. The electrode assembly of claim 1 wherein said at least one electrode bundle is a first electrode bundle having a plurality of first electrodes and a second electrode bundle having a plurality of second electrodes; wherein said first electrode bundle is structured to be disposed on said fixed contact assembly; and wherein said second electrode bundle is structured to be disposed on said movable contact assembly.

5. The electrode assembly of claim 4 wherein said first electrodes are structured to extend between the fixed contact and the first end of said vacuum envelope; and wherein said second electrodes are structured to extend from proximate the movable contact through the second end of said vacuum envelope.

6. The electrode assembly of claim 5 wherein said first electrode bundle comprises twelve first electrodes arranged in a concentric circular pattern; and wherein said second electrode bundle comprises five second electrodes arranged in a concentric circular pattern.

7. An electrode assembly for a vacuum switch, said vacuum switch comprising a vacuum envelope, a fixed contact assembly including a fixed contact disposed within said vacuum envelope, and a movable contact assembly including a movable contact disposed within said vacuum envelope and movable between a closed position in electrical contact with the fixed contact and an open position spaced apart from the fixed contact, said vacuum envelope including a first end and a second end disposed opposite and distal from the first end, said electrode assembly comprising:

at least one electrode bundle including a plurality of electrodes structured to be coupled to a corresponding one of said fixed contact assembly and said movable contact assembly, wherein said electrodes are structured to extend from at or about a corresponding one of the fixed contact and the movable contact toward the closer of the first end of said vacuum envelope and the second end of said vacuum envelope, and wherein said vacuum switch further comprises a longitudinal axis; and wherein said electrodes are twisted with respect to said longitudinal axis.

8. The electrode assembly of claim 7 wherein said fixed contact assembly further includes a stem, a first planar member, and a second planar member disposed opposite ad distal from the first planar member; wherein each of said electrodes includes a first end structured to be coupled to the first planar member and a second end structured to be coupled to the second planar member; and wherein the second end of each electrode is offset with respect to the first end of said electrode.

9. An electrode assembly for a vacuum switch, said vacuum switch comprising a vacuum envelope, a fixed contact assembly including a fixed contact disposed within said vacuum envelope, and a movable contact assembly including a movable contact disposed within said vacuum envelope and movable between a closed position in electrical contact with the fixed contact and an open position spaced apart from the fixed contact, said vacuum envelope including a first end and a second end disposed opposite and distal from the first end, said electrode assembly comprising:

at least one electrode bundle including a plurality of electrodes structured to be coupled to a corresponding one of said fixed contact assembly and said movable contact assembly, wherein said electrodes are structured to extend from at or about a corresponding one of the fixed contact and the movable contact toward the closer of the first end of said vacuum envelope and the second end of said vacuum envelope, and wherein said electrodes are disposed in a weaving or braiding manner.

10. The electrode assembly of claim 1 wherein each of said electrodes has a diameter; and wherein the diameter of some of said electrodes is different than the diameter of at least some other electrodes.

11. A vacuum switch comprising:

a vacuum envelope including a first end and a second end disposed opposite and distal from the first end;

a fixed contact assembly including a fixed contact disposed within said vacuum envelope;

a movable contact assembly including a movable contact disposed within said vacuum envelope and movable between a closed position in electrical contact with the fixed contact and an open position spaced apart from the fixed contact; and an electrode assembly comprising:

at least one electrode bundle comprising a grouping of a plurality of separate relatively small diameter electrodes bundled together and coupled to a corresponding one of said fixed contact assembly and said movable contact assembly, wherein said electrodes extend from at or about a corresponding one of the fixed contact and the movable contact toward the closer of the first end of said vacuum envelope and the second end of said vacuum envelope.

12. The vacuum switch of claim 11 wherein said electrodes are completely disposed within said vacuum envelope.

13. The vacuum switch of claim 11 wherein said electrodes extend from within said vacuum envelope through a corresponding one of the first end of said vacuum envelope and the second end of said vacuum envelope.

14. The vacuum switch of claim 11 wherein said at least one electrode bundle is a first electrode bundle having a plurality of first electrodes and a second electrode bundle having a plurality of second electrodes; wherein said first electrode bundle is disposed on said fixed contact assembly; and wherein said second electrode bundle is disposed on said movable contact assembly.

15. The vacuum switch of claim 14 wherein said first electrodes extend between the fixed contact and the first end of said vacuum envelope; and wherein said second electrodes extend from proximate the movable contact through the second end of said vacuum envelope.

16. The vacuum switch of claim 15 wherein said first electrode bundle comprises twelve first electrodes arranged in a concentric circular pattern; and wherein said second electrode bundle comprises five second electrodes arranged in a concentric circular pattern.

17. A vacuum switch comprising:

a vacuum envelope including a first end and a second end disposed opposite and distal from the first end;

a fixed contact assembly including a fixed contact disposed within said vacuum envelope;

a movable contact assembly including a movable contact disposed within said vacuum envelope and movable between a closed position in electrical contact with the fixed contact and an open position spaced apart from the fixed contact; and an electrode assembly comprising:

at least one electrode bundle including a plurality of electrodes coupled to a corresponding one of said fixed contact assembly and said movable contact assembly, wherein said electrodes extend from at or about a corresponding one of the fixed contact and the movable contact toward the closer of the first end of said vacuum envelope and the second end of said vacuum envelope, and wherein said vacuum switch further comprises a longitudinal axis; and wherein said electrodes are twisted with respect to said longitudinal axis.

18. The vacuum switch of claim 17 wherein said fixed contact assembly further includes a stem, a first planar member, and a second planar member disposed opposite and distal from the first planar member; wherein each of said electrodes includes a first end coupled to the first planar member and a second end coupled to the second planar member; and wherein the second end of each electrode is offset with respect to the first end of said electrode.

19. A vacuum switch comprising:

a vacuum envelope including a first end and a second end disposed opposite and distal from the first end;

a fixed contact assembly including a fixed contact disposed within said vacuum envelope;

a movable contact assembly including a movable contact disposed within said vacuum envelope and movable between a closed position in electrical contact with the fixed contact and an open position spaced apart from the fixed contact; and an electrode assembly comprising;

at least one electrode bundle including a plurality of electrodes coupled to a corresponding one of said fixed contact assembly and said movable contact assembly, wherein said electrodes extend from at or about a corresponding one of the fixed contact and the movable contact toward the closer of the first end of said vacuum envelope and the second end of said vacuum envelope, and wherein said electrodes are disposed in a weaving or braiding manner.

20. The vacuum switch of claim 11 wherein each of said electrodes has a diameter; and wherein the diameter of some of said electrodes is different than the diameter of at least some other electrodes.

* * * * *